US005350890A

United States Patent [19]

Fairbrother et al.

[11] Patent Number: 5,350,890

[45] Date of Patent: Sep. 27, 1994

[54] CONTACT SWITCH DEVICE

[75] Inventors: Brian Fairbrother, Leigh-On-The-Sea; Paul Rose; Richard Farman, both of Ilford, all of England

[73] Assignee: Gould Instrument Systems, Inc., Valley View, Ohio

[21] Appl. No.: 954,531

[22] Filed: Oct. 1, 1992

[51] Int. Cl.[5] ..... H01H 1/10; H01H 9/26

[52] U.S. Cl. ..... 200/5 A; 200/512

[58] Field of Search ..... 200/5 R, 5 A, 1 B, 1 R, 200/18, 512, 513–517

[56] References Cited

U.S. PATENT DOCUMENTS

| | | | |
|---|---|---|---|
| 4,349,712 | 9/1982 | Michalski | 200/159 B |
| 4,376,238 | 3/1983 | Martin | 200/513 |
| 4,409,450 | 10/1983 | Blades | 200/512 |
| 4,527,030 | 7/1985 | Oelsch | 200/515 |
| 4,668,843 | 5/1987 | Watanabe et al. | 200/5 A |
| 4,710,597 | 12/1987 | Loheac | 200/5 A |
| 4,851,626 | 7/1989 | Nagashima | 200/5 A |

*Primary Examiner*—A. D. Pellinen

*Assistant Examiner*—Michael A. Friedhofer

*Attorney, Agent, or Firm*—D. Peter Hochberg; Mark Kusner; Michael Jaffe

[57] ABSTRACT

A switch assembly including a base member and at least one pair of conductors provided on the base member which are to be electrically connected. An outer baffle extends over the base member and the conductors and is comprised of a conical wall having a key formed at the apex thereof and an outward flaring pad at the bottom thereof for engagement with the base member, the outer baffle including a recess beneath the key opening toward the base member. An inner baffle is dimensioned to be positioned within the outer baffle and includes a conical wall having a plug at the apex thereof and a pad formed at the bottom thereof. The plug is dimensioned to be received within the recess of the outer baffle such that the conical walls of the outer baffle and the inner baffle are symmetrical about a common axis. The pad on the inner baffle is spaced a predetermined distance above the base. A conductive element is provided on the inner baffle to electrically connect the conductors when the outer baffle collapses.

15 Claims, 6 Drawing Sheets

CONTACT SWITCH DEVICE

FIELD OF THE INVENTION

The present invention relates generally to switching devices for controlling the passage of electrical signals, and more particularly, to an elastomeric membrane contact switch which is adapted to be used for operating electronic equipment.

BACKGROUND OF THE INVENTION

Elastomeric membrane contact switches have become widely used in many applications in the electronics industry. Such switches have been used individually to control switching functions on electronic instruments such as stereo equipment or laboratory recorders or monitors, and have been molded into grid-like arrays of side-by-side switches to provide keypads for calculators, adding machines or the like. In many of these applications, it is desirable to provide a double acting switch which is capable of initiating or controlling two electrical states. To this end, it is necessary that the switch have a tactile feel wherein initiation of the first or second states is readily perceptible to the user.

The present invention provides a contact key switch device which provides a noticeable tactile feel when initiating a switch activation state and which may be configured to function as a single action switch or a double action switch.

SUMMARY OF THE INVENTION

In accordance with the present invention there is provided a contact-type key switch comprised of a base member, circuit means including a plurality of conductors which are to be electrically connected, an inner member and an outer membrane. The outer membrane extends over the baseplate and has an actuator key at the upper end thereof, a support pad at the lower end thereof, and a wall portion connecting the upper end to the lower end. The wall portion flares outwardly from the actuator key to the support pad and has a predetermined collapse lead characteristic. The inner membrane is smaller than the outer membrane and has an upper end, a lower end, and a wall portion connecting the upper and lower end. The wall portion flares outwardly from the upper end to the lower end and has a predetermined collapse lead characteristic. The inner membrane is mounted to the outer membrane wherein the lower end of the inner membrane is a predetermined distance above the circuit means. A first electrical conductor is mounted to the lower end of the inner membrane and a second electric conductor member is mounted within the wall portion of the inner membrane such that the second electrical conductor is spaced a predetermined distance above the first electrical conductor. The first electric conductor on the inner membrane operates to electrically connect selected connectors in the circuit means when the outer membrane exceeds its collapse lead characteristic and the second electric conductor operates to connect other connectors in the circuit means when the inner membrane exceeds its collapse lead characteristic.

In accordance with another aspect of the present invention there is provided a keypad comprised of a plurality of the above-described switch arranged side-by-side in a grid-like array, each of the switches in the keypad having first and second activation states.

It is an object of the present invention to provide a double acting contact-type membrane key switch device.

Another object of the present invention is to provide a switch device as described above which has a noticeable tactile feel upon activation of a switch state.

Another object of the present invention is to provide a switch device as described above having clearly identifiable collapse load points.

A still further object of the present invention is to provide a switch device as described above which includes an inner membrane and an outer membrane wherein each membrane has an identifiable collapse point.

A still further object of the present invention is to provide a contact-type switch which may be modified to act as a single acting switch or a double acting switch.

A still further object of the present invention is to provide a switch device as described above which is comprised of an inner conical cup and an outer conical cup wherein the inner cup may have one or more contacts thereon and is removable from the outer conical membrane.

A still further object of the present invention is to provide a membrane keypad comprised of a plurality of side-by-side contact-type switches which are integrally formed of an elastomeric material, wherein each switch may be modified to act as a single action switch or a double action switch.

These and other objects and advantages will become apparent from the following description of preferred embodiments taken together with the accompanying drawings.

BRIEF DESCRIPTION OF THE DRAWINGS

The invention may take physical form in certain parts and arrangement of parts, preferred embodiments of which will be described in detail in the specification and illustrated in the accompanying drawings which form a part hereof and wherein.

DESCRIPTION OF PREFERRED EMBODIMENT

Figure 1:
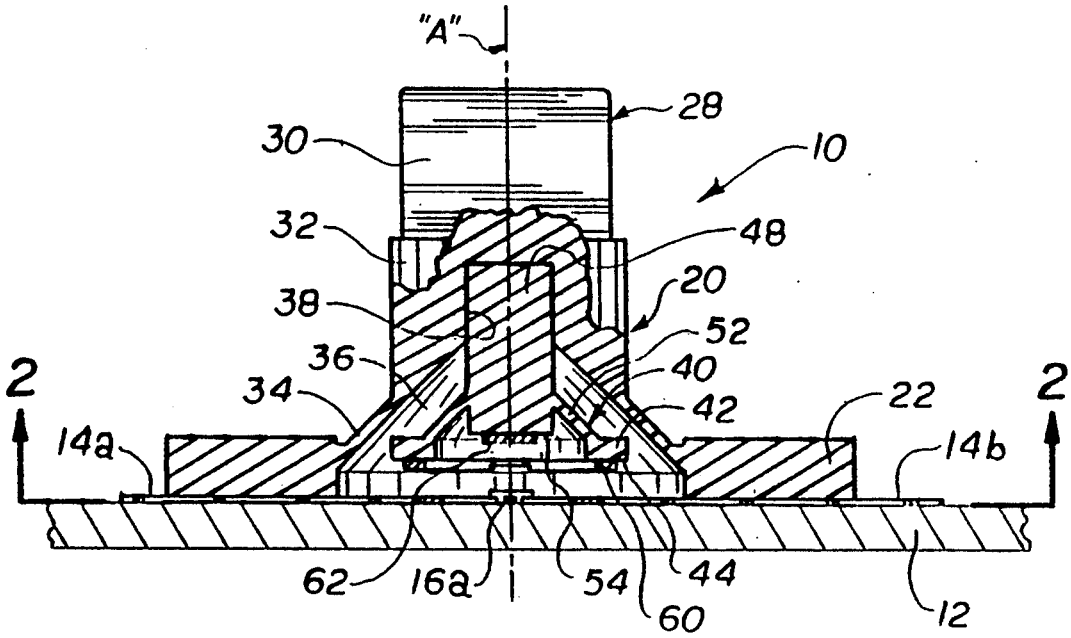
FIG. 1 is a sectional, side elevational view showing a double action contact-type switch according to the present invention.
Figure 3C:
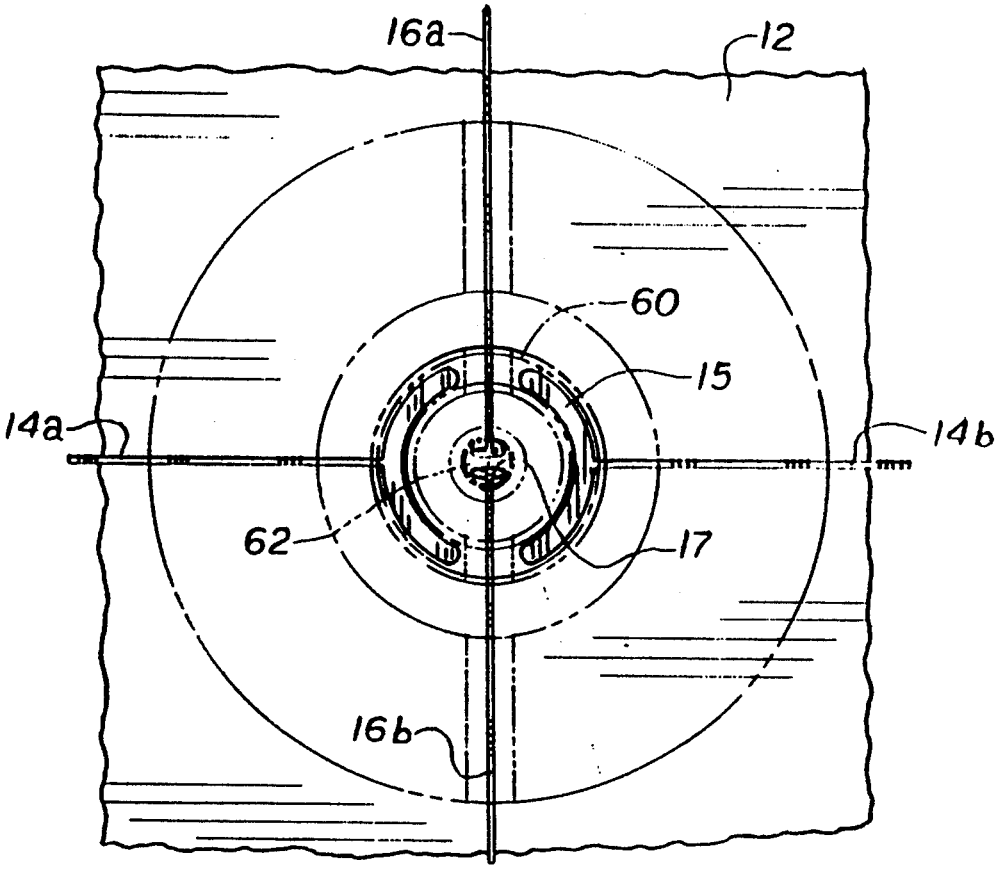
FIG. 3 is a plan view of a circuit board having a plurality of conductors thereon showing in phantom the position of the switch shown in FIG. 1 relative thereto.
Figure 3A:
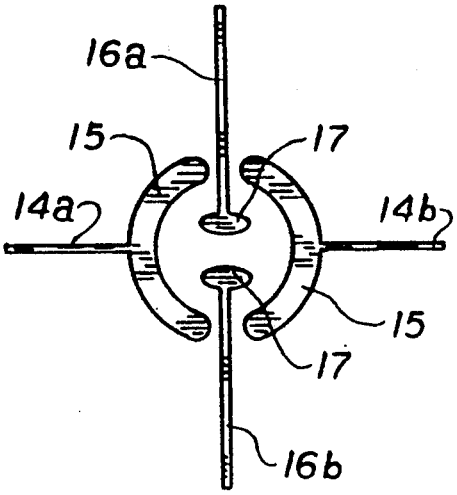
Figure 3B:
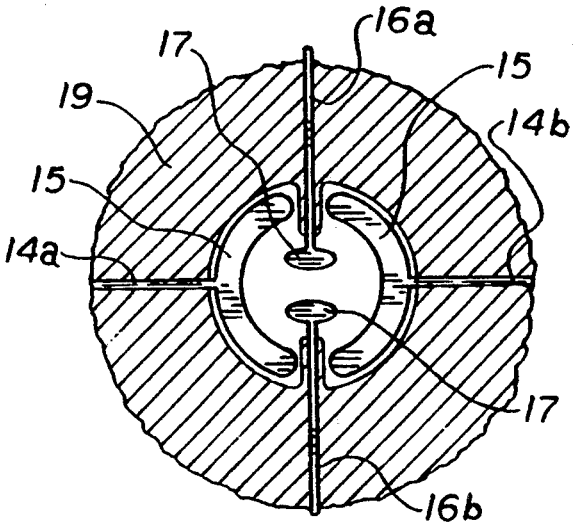
Figure 9:
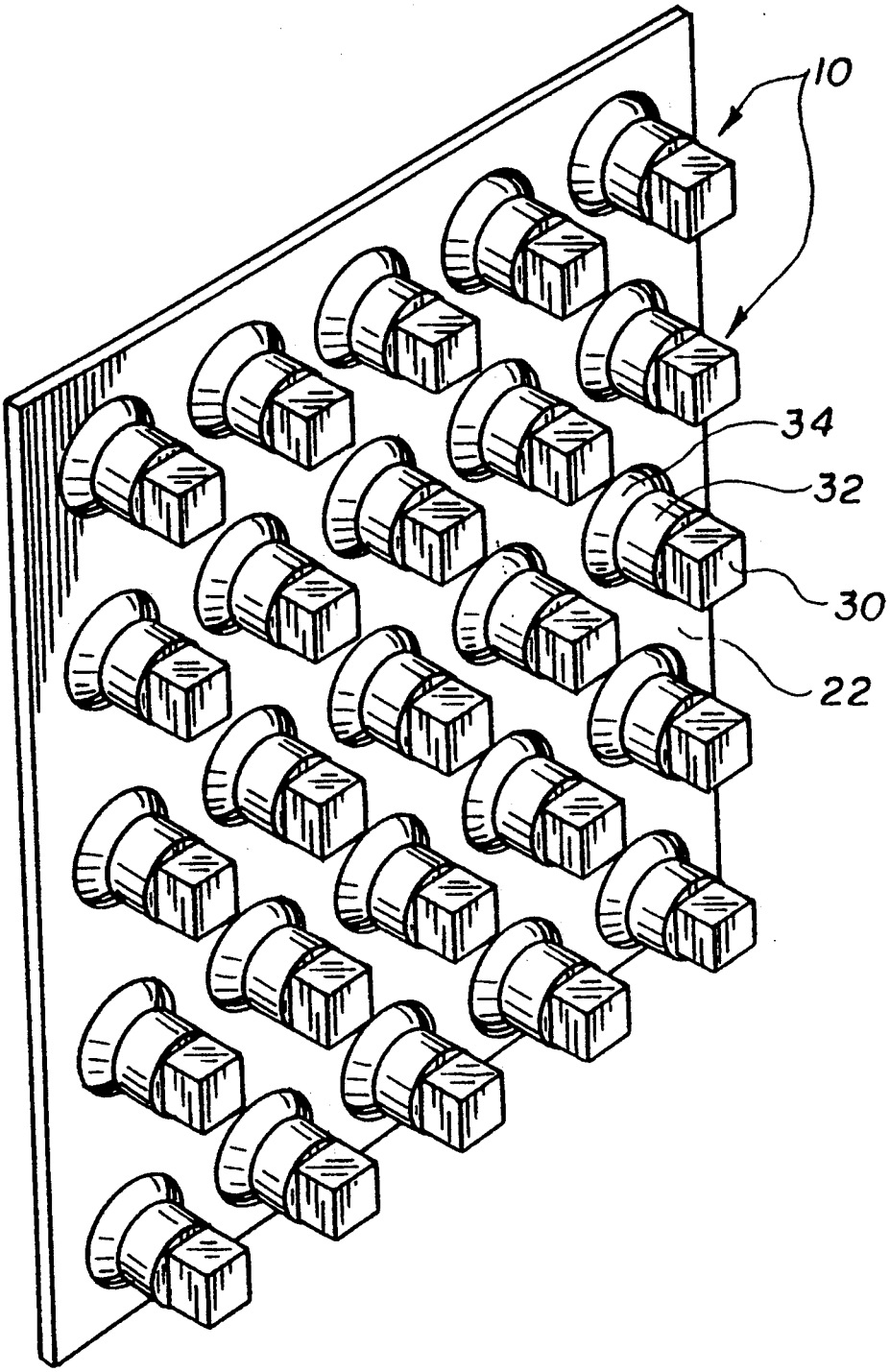
FIG. 9 is a perspective view of a keypad illustrating another embodiment of the present invention.

Referring now to the drawings wherein the showings are for the purpose of illustrating preferred embodiments of the invention only and not for the purpose of limiting the same, FIG. 1 illustrates a double action contact-type membrane switch 10 according to the present invention. Switch 10 would typically be formed as a part of the larger switch membrane mat, as shown in FIG. 9, having a plurality of switches 10 arranged side-by-side in a grid-like array. Such mats are conventionally used as keypads on calculators and the like. Hereinafter, a single switch 10 will be described in detail, it being understood that such description applies equally to other switches in a membrane mat. Switch 10 is formed on a planar surface of a base member 12 of insulating material. In the embodiment shown, base 12 carries two (2) pairs of electrical conductors designated 14*a*, 14*b*, 16*a*, and 16*b* in the drawings having contacts 15 and 17 respectively at the ends thereof. Conductors 14*a*, 14*b*, 16*a* and 16*b* would typically be formed as part of a larger printed circuit (not shown) wherein the circuit and electrical conductors 14*a* 14*b*, 16*a* and 16*b* would be bonded to base 12. FIG. 3A shows a typical conductor layout for contact-type membrane switch 10. In the embodiment shown, conductors 14*a* and 14*b* are aligned end-to-end, with contacts 15 spaced-apart. Conductors 16*a* and 16*b* are aligned to be generally perpendicular to the path of conductors 14*a* and 14*b*, with contacts 17 spaced-apart from each other and from contacts 15. A thin, solid resist layer 19, as shown in FIG. 3B, covers conductors 14*a*, 14*b*, 16*a* and 16*b*, but leaves contacts 15 and 17 exposed.

Figure 2:
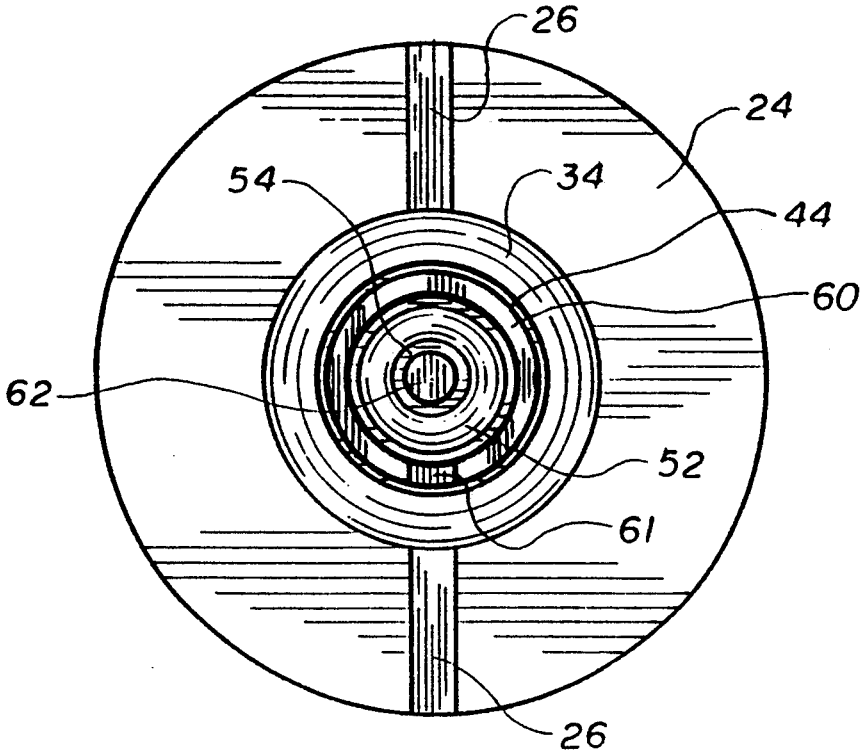
FIG. 2 is a sectional view taken along the line 2—2 of FIG. 1.

Switch 10 includes a first outer membrane 20 which is generally shaped as an inverted cone or cup. In the embodiment shown, membrane 20 includes a pad 22 dimensioned to rest upon solder resist layer 19 on base member 12. Pad 22 has a flat annular shape with a planar lower surface 24. In the embodiment shown, aligned grooves 26 (best seen in FIG. 2) are formed in lower surface 24. Grooves 26 are provided to allow air to be expelled from under switch 10 upon activation thereof, as shah be described in greater detail below. The upper end of membrane 20 is formed as a burton or key 28 and includes an upper key portion 30 which, in the embodiment shown, is generally rectangular in cross-section and a lower key portion 32 which is generally cylindrical in shape. Upper key portion 30 and lower key portion 32 are generally symmetrical about an axis, designated "A" in the drawings, which is generally perpendicular to base member 12. Button 28 and more particularly, lower key portion 32, are dimensioned to extend through at panel or cover plate (not shown) as typically found with such switches. In this respect, as will be appreciated, upper key portion 30 is not limited to a rectangular cross-section, but may assume any cross-section provided that the maximum profile of the cross-section is maintained within the profile of the cylindrical lower key portion 32. A generally conical wall 34 which is generally symmetrical about axis "A" connects pad 22 to key or button 28. Outer membrane 20 would typically be molded as an integral part of the elastomeric base member 22 (illustrated in FIG. 9) which would in turn be secured to location spigots or clamp fixings to the base member 12.

It is to be understood that reference herein to expressions such as "upper", "lower", "inner", "outer" and "under" are intended to refer to the disposition of the elements as shown in the drawings and are not to be interpreted as requiring a particular switch orientation when used.

A generally conical shaped cavity 36 is defined within switch membrane 20, a portion of which projects into key 28. At the apex of conical cavity 36, a cylindrical bore 38 extends along axis "A" into a portion of lower key section 32.

A second switch membrane 40 is dimensioned to be disposed within cavity 36 of first switch membrane 20. Second switch membrane 40 is generally comprised of an annular pad 42 having a generally planar lower surface 44. A generally cylindrical body or plug 48 forms the upper portion of second switch membrane 40. A conical wall 52 connects body 48 with pad 42 and is symmetrical about axis "A". Second switch membrane 40 is formed such that a generally flat surface 54 facing base member 12 is formed below plug 48. Surface 54 is generally parallel to and spaced a predetermined distance above lower surface 44 of pad 42. According to the present invention, an electrically conductive ring 60 is provided on lower surface 44 of pad 42. In the embodiment shown, ring 60 is symmetrically positioned relative to axis "A" and disposed above contacts 15 on conductors 14*a*, 14*b*. Grooves 61 are formed in the lower surface of ring 60 to allow air to be expelled from under second switch membrane 40. A second electrical conductor 62 is provided on surface 54. In the embodiment shown, second electrical conductor 62 is generally circular in shape.

According to the present invention, plug 48 of second membrane 40 is dimensioned to be snugly received within bore 38 of first switch membrane 20, wherein both conical walls 34 of switch membrane 20 and conical wall 52 of switch membrane 40 are symmetrical about axis "A". Both switch membranes 20 and 40 are preferably formed of a resilient elastomeric material. In this respect, switch membranes 20 and 40, and more specifically conical walls 34 and 52, are deformable when a force is applied along axis "A".

Figure 4:
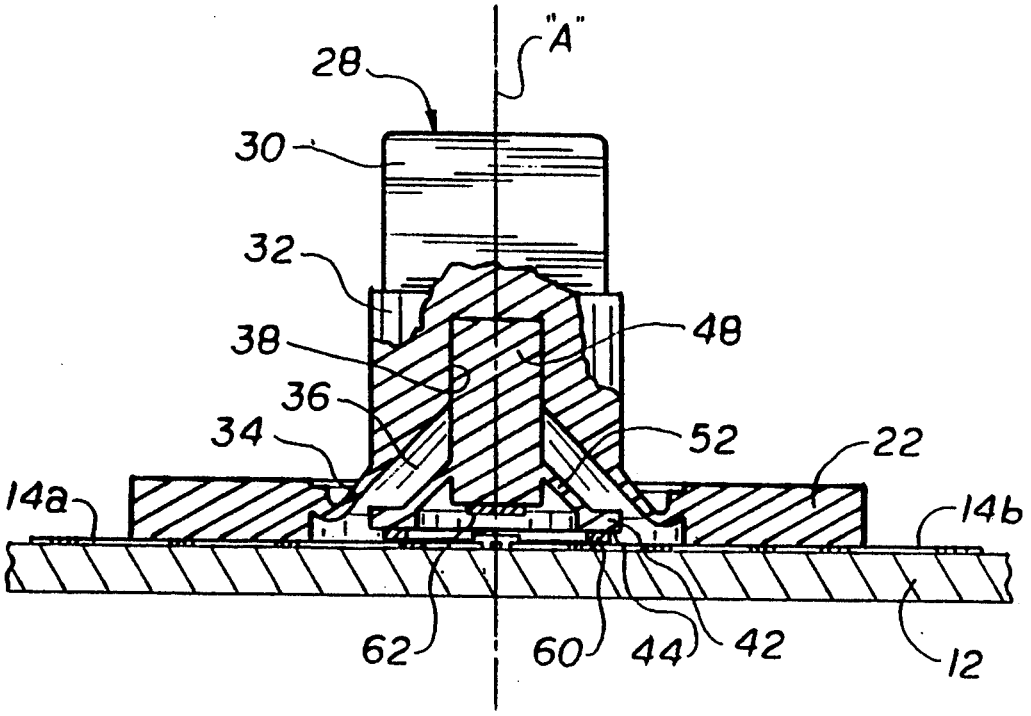
FIG. 4 is a sectioned, side elevational view of the switch shown in FIG. 1 showing the switch in a first state of actuation.
Figure 5:
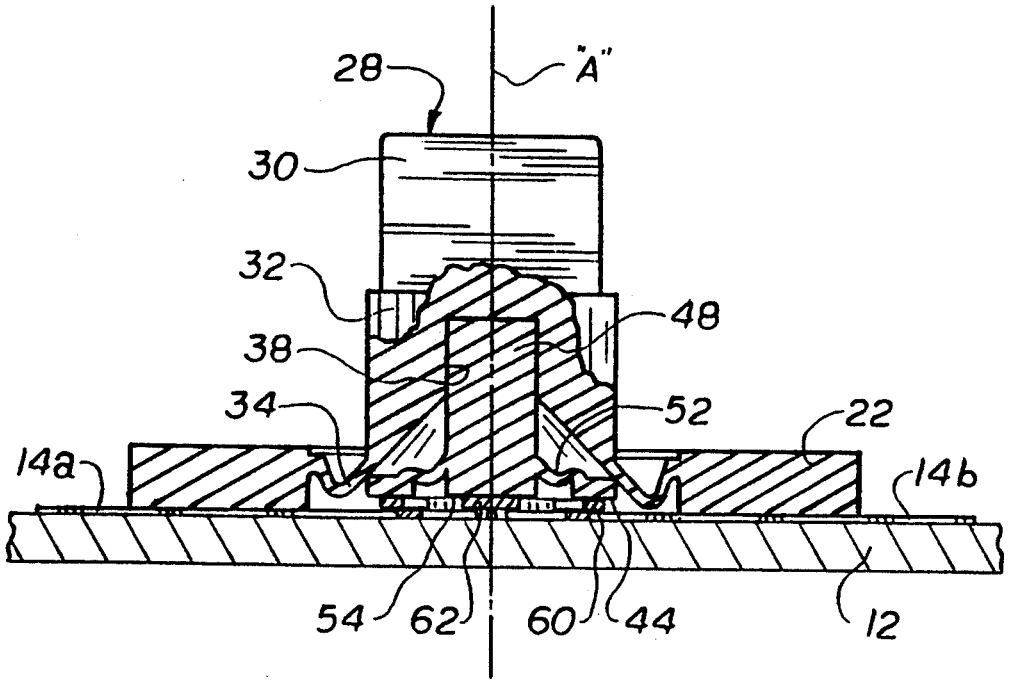
FIG. 5 is a sectioned, side elevational view of the switch shown in FIG. 1 showing the switch in a second state of actuation.

Referring now to the operation of switch 10, as an axial force is applied to key 28 along axis "A", cavity 36 will collapse when the applied force is sufficient to force conical wall 34 of switch membrane 20 to collapse. As conical wall 34 collapses, conductive ring 60 on pad 42 of switch membrane 40 engage contacts 15 of connectors 14*a*, 14*b*, on base member 12 as shown in FIG. 4. In the embodiment shown, conductor 14*a* is thus electrically connected to conductor 14*b*. Importantly, the solid resist layer 19 covering the portion of conductors 16*a*, 16*b* below ring 60 prevents ring 60 from electrically connecting same.

Further depression of key 28 causes conical wall 52 of second switch membrane 40 to collapse wherein electrical connector 62 is brought into contact with contacts 17 of conductors 16*a*, 16*b* and electrically connects same. Importantly, a perceptible tactile sensation is provided for each switch activation state. In this respect, conical walls 34, 52 are each dimensioned to have a collapse point sufficiently high so as to be noticeable by the user of the switch.

Figure 6:
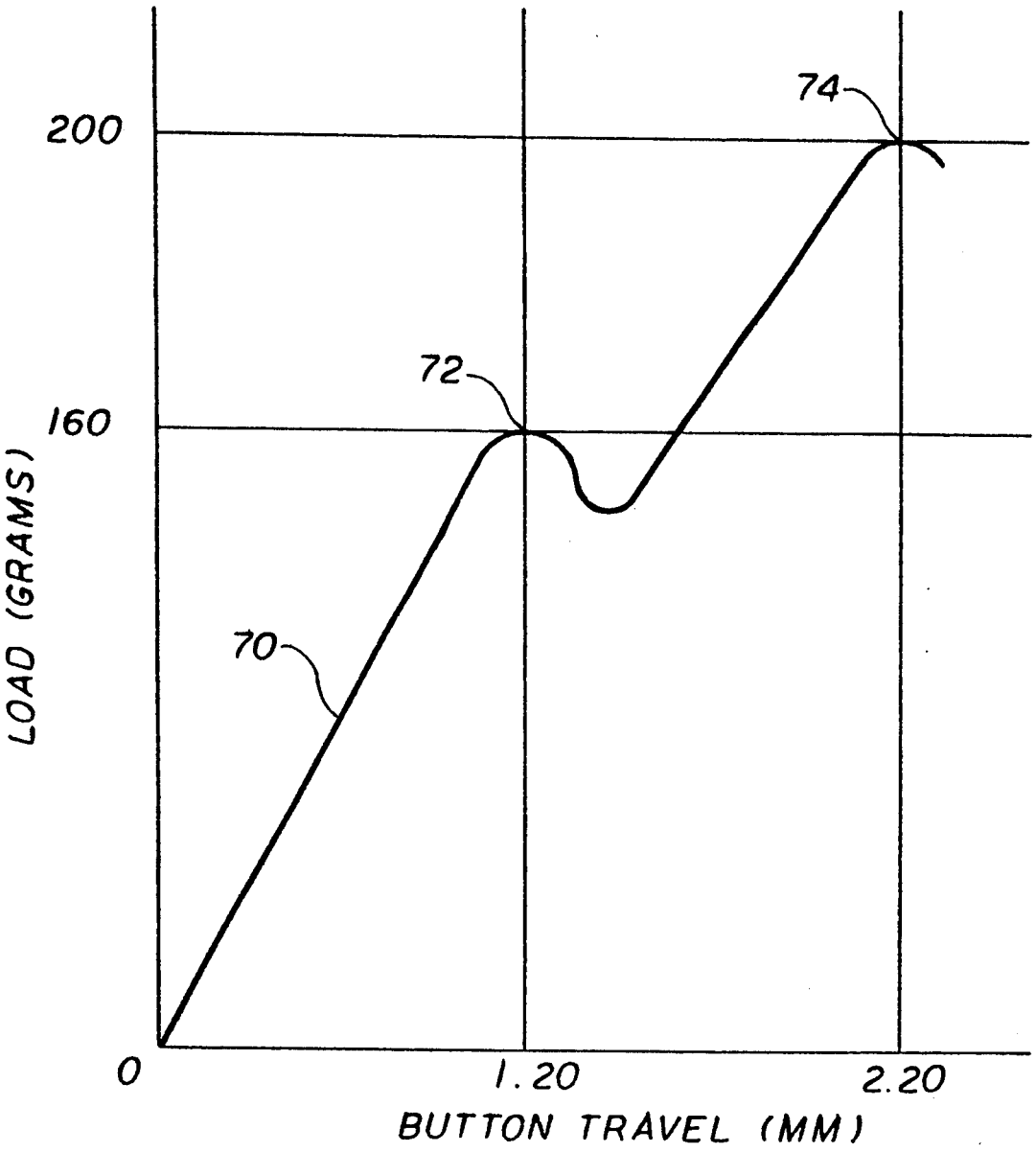
FIG. 6 is a graph showing button travel versus actuating load for the switch shown in FIG. 1.

FIG. 6 is a graph showing a curve line 70 representing the loading (in grams) required to initiate collapse of respective conical walls 34, 52 versus the distance in millimeters (mm) key 28 travels before initiation of each activation state. In the embodiment shown, a force of 160 grams is required to be exerted on key or button 28 to collapse conical wall 34 of first switch membrane 20 to initiate a first activation state. Key or button 28 travels approximately 1.2 mm before conical wall 34 collapses as shown at peak 72 of curve 70. In this respect, curve 70 shows two peaks 72, 74 representative of the collapse points of conical walls 34, 52 respectively. Peak 74 of curve 70 illustrates that 200 grams are required to overcome first membrane 20 and to collapse conical wall 52. Importantly, because first switch membrane 20 and second switch membrane 40 are individual components, the respective conical walls 34, 52 can be individually formed to have specific, identifiable collapse points which provide a distinct tactile feel when each switch state is activated. As will be appreciated, the loading shown in FIG. 6 and discussed above, represents a typical loading and are not intended to imply or suggest limits to the present invention.

Figure 7:
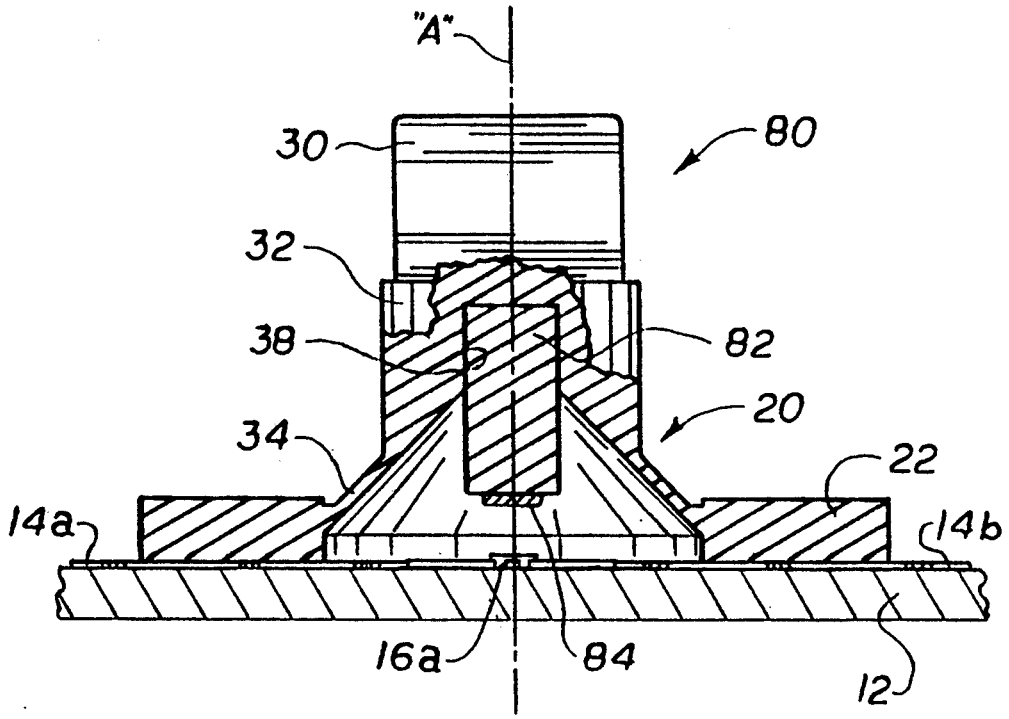
FIG. 7 is a sectioned, side elevational view of a contact-type switch illustrating another embodiment of the present invention.
Figure 8:
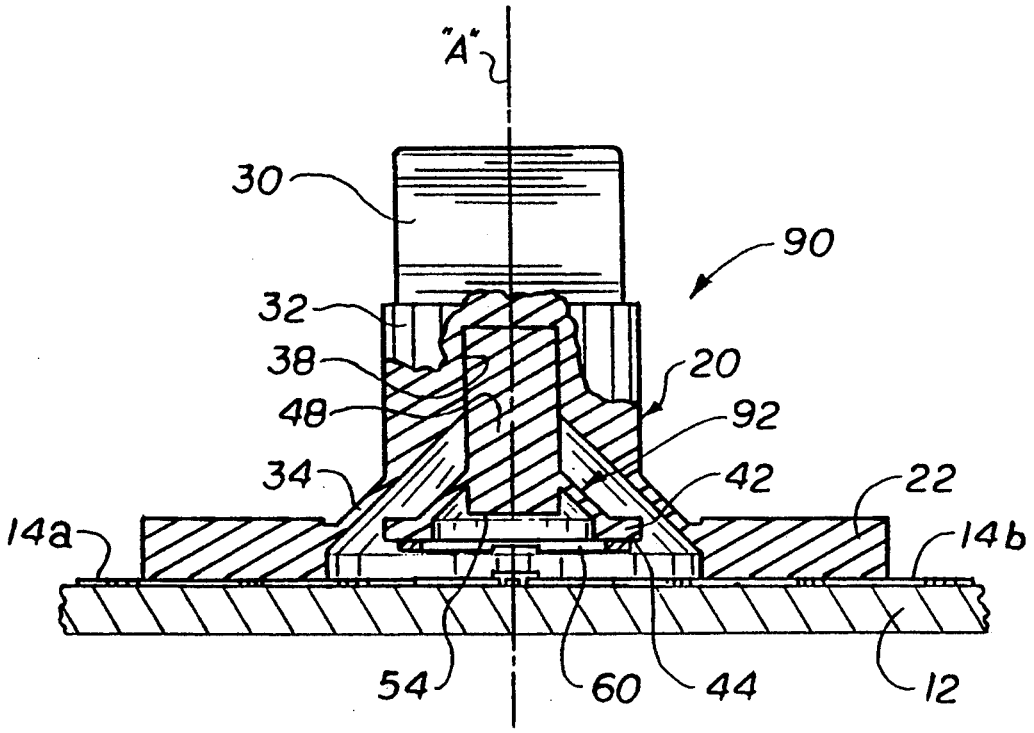
FIG. 8 is a sectioned, side elevational view of a contact-type switch illustrating a still further embodiment of the present invention.

More importantly, the present invention provides a switch wherein the second switch membrane may be modified and replaced to vary either the operating characteristics of the switch, i.e., the force required to collapse second switch membrane 40 or the distance of travel between the first actuation state and the second actuation state. In addition, the operation of the switch can also be modified by replacing second switch membrane 40. In this respect, because second switch membrane 40 is removably mounted within first switch membrane 20, it may be replaced by a membrane having a different shape. FIGS. 7 and 8 show alternate embodiments of the switch shown in FIG. 1.

Specifically, FIG. 7 shows a switch 80 having a first membrane 20 which is identical in all respects to membrane 20 shown in FIG. 1. Switch 80 includes an inner plug 82 dimensioned to be received within cylindrical bore 38 of first switch membrane 20. Plug 82 includes an electrical connector 84 at the lower end thereof. As will be appreciated, switch 80 has only a single activation state which occurs when conical wall 34 of first switch membrane 20 collapses.

FIG. 8 shows a switch 90 having a first membrane 20 which is identical in all respects to membrane 20 shown in FIG. 1. Switch 90 also includes a second switch membrane 92 generally similar to second switch membrane 40 of FIG. 1, but absent an electrical connector 62 on the lower downward facing flat surface 54 of plug 48. In other words, only the lower surface 44 of annular pad 42 has electrical connectors thereon. In this respect, switch 90 has a single activation state which occurs when conical wall 34 of first switch membrane 20 collapses. Further depression of key or button 28 will eventually collapse conical wall 52 of second switch membrane 92, but became the lower flat surface 54 of body 48 does not have a connector thereon, the conductor therebelow will not be bridged.

Because the switch, according to the present invention, my be easily modified to a plurality of different switch configurations by merely replacing the inner membrane or plug within first switch membrane 20, such switch finds advantageous application as a single switch component or as part of an array of keys (i.e., a keyboard) for instruments where it is desirable to vary the operating parameters of a single switch or one or more switches in an array.

For example, a manufacturer of laboratory test equipment may offer a basic laboratory recorder. In addition, the manufacturer may offer several other models or variations of the basic recorder, each model including more features than the basic model. For economy, it would be desirable to manufacture the basic recorder with the electronic switch wiring and circuitry adaptable for all models or variations thereof. In this respect, a switch on the basic recorder may control a single function whereas the same switch on the higher model would operate two functions. If the basic recorder was designed to include the appropriate electrical switch conductors, a switch of the type heretofore described could be used in both models, wherein each recorder model would include the same first outer membrane but depending on what conductors needed to be connected, would include an inner membrane or plug selected to accomplish such function.

In similar respects, a key on a keypad array or calculator may control a single function on a specific version of the calculator and may control two functions on a different version of the same calculator. Clearly, for economy of manufacture, it would be desirable to have the same basic circuit board below the keypad. With a membrane switch according to the present invention, an array of first switch membranes may be formed side-by-side to produce the keypad, and specially formed inner switch membranes may be inserted at specific locations within the keypad array to accomplish specific functions required at that position in the array. In other words, one key in the keypad may have an inner membrane which provides a single action switch, while the adjacent key in the keypad has an inner membrane providing a double acting switch. By simply varying the configuration of the inner membrane, a keypad having a plurality of keys may be easily adapted to a variety of configurations.

Thus, the present invention provides a versatile switch arrangement which finds advantageous application in modifying existing switches to perform one or more functions, and also provides a switch having clearly identifiable tactile switch activation states.

The present invention has been described with respect to preferred embodiments. Modifications and alterations will occur to others upon a reading and understanding of the specification. It is intended that all such modifications and alterations be included insofar as they come within the scope of the invention as claimed, or equivalents thereof.

Thus, having described the invention, the following is claimed:

1. A contact-type key switch comprised of:

a base member, circuit means including a plurality of conductors which are to be electrically connected, an outer membrane extending over said base plate, said membrane having an actuating key at the upper end thereof, a support pad at the lower end thereof and a wall portion flaring outwardly from said actuating key to said support pad, said wall portion having a predetermined collapse load characteristic, an inner membrane separate from said outer membrane, said inner membrane being smaller than said outer membrane and having an upper end, a lower end, and a wall portion flaring outwardly from said upper end to said lower end, said wall portion having a predetermined collapse load characteristic, said inner membrane mounted to said outer membrane below said actuating key wherein said lower end of said inner membrane is a predetermined distance above said circuit means, a first electric conductor member mounted to said lower end of said inner member, a second electric conductor member mounted within said wall portion of said inner membrane and below said upper end of said inner membrane, and said first electric conductor on said inner membrane electrically connecting selected ones of said conductors in said circuit means when said outer membrane exceeds its collapse load characteristic and said second electric conductor connecting other conductors in said circuit means when said inner membrane exceeds its collapse load characteristic.

2. A switch as defined in claim 1 wherein said inner membrane and said outer membrane are generally conical in shape.

3. A switch as defined in claim 1 wherein said wall portion of said outer membrane has a collapse load of approximately 160 grams.

4. A switch assembly including:

a base member, at least one pair of conductors provided on said base member which are to be electrically connected, an outer baffle extending over and resting upon said base member creating a cavity therebetween, said cavity containing said conductors, said outer baffle comprised of a conical wall having a key formed at the apex thereof and an outward flaring pad at the bottom thereof for engagement with said base member, said outer baffle including a recess beneath said key opening toward said base member, an inner baffle dimensioned to be positioned within said cavity, said inner baffle including a conical wall having a plug at the apex thereof and a pad formed at the bottom thereof, said plug dimensioned to be received within said recess of said outer baffle such that said conical walls of said outer baffle and said inner baffle are symmetrical about a common axis and said pad on said inner baffle is spaced a predetermined distance above said base, and at least one conductive means on said inner baffle operable to electrically connect said conductor when said outer baffle collapses.

5. A switch assembly as defined in claim 4 wherein:

at least two pairs of conductors are provided on said base member which are to be electrically connected in pairs, and said inner baffle includes a first conductive means and a second conductive means, said first conductive means engaging and electrically connecting one pair of said connectors when said outer baffle collapses and said second conductive means engaging and electrically connecting the other pair of said connectors when said inner baffle collapses.

6. A double acting contact-type switch comprised of:

a resilient first member in the form of a cone having a key formed at the apex thereof and a generally planar pad formed at the bottom thereof, said pad adapted to be mounted onto a generally planar base member having a plurality of conductors which are to be electrically connected, said first member positioned such that said key is generally disposed above said conductors to be connected, said first member having a generally conical wall connecting said key to said pad, said conical wall dimensioned to collapse when a predetermined force perpendicular to said base is applied to said key, and a resilient second member in the form of an inverted cone, said second member having a conical wall connecting a mounting lug at the apex thereof with a pad at the lower opened end thereof, said second being smaller than said first member and being attached thereto by said mounting lug between said first member and said base with the pad of said second member facing said base and being spaced therefrom, said conical wall dimensioned to collapse when a predetermined force perpendicular to said base is applied thereto, first conductive means mounted to said pad of said second member operable to engage selected ones of said plurality of conductors on said base member when said conical wall of said first member collapses, and second conductive means on said second member operable to engage others of said plurality of conductors on said base member when said conical wall of said second member collapses.

7. A switch as defined in claim 6 wherein said collapse force for said first member and said second member is between 200 grams.

8. A switch as defined in claim 6 wherein said second member is removably attached to said first member.

9. A contact-type key switch comprised of:

a base member, circuit means including a plurality of conductors which are to be electrically connected, an outer membrane extending over said base plate, said membrane having an actuating key at the upper end thereof, a support pad at the lower end thereof and a wall portion flaring outwardly from said actuating key to said support pad, said support pad resting on said base member and defining a cavity therebetween and said wall portion having a predetermined collapse load characteristic, an inner member separate from said outer membrane, said inner member being smaller than said outer membrane and having an upper end and a lower end, said inner member being insertable in said outer membrane below said actuating key and being disposed within said cavity wherein said lower end of said inner member is a predetermined distance above said circuit means, and;

at least one electric conductor mounted to said inner member, said electric conductor on said inner member electrically connecting selected ones of said conductors in said circuit means when said outer membrane exceeds its collapse load characteristic.

10. A switch as described in claim 9 wherein said inner member has a wall portion flaring outwardly from said upper end to said lower end, said wall portion having a predetermined collapse load characteristic.

11. A switch as described in claim 10 wherein said inner member includes a first electric conductor and a second electric conductor, said first electric conductor electrically connecting selected ones of said conductors in said circuit means when said outer membrane exceeds its collapse load characteristic and said second electric conductor connecting other conductors in said circuit means when said inner membrane exceeds its collapse load characteristic.

12. A switch as defined in claim 10 wherein the wall portion of the inner member and the outer membrane are generally conical in shape.

13. A switch as defined in claim 9 wherein said wall portion of said outer membrane has a collapse load of approximately 160 grams.

14. A switch as defined in claim 10 wherein said wall portion of said inner member has a collapse load of approximately 200 grams.

15. A keypad for an electronic instrument, comprising:

a base member, circuit means located on said base member including a plurality of groups of conductors which are to be electrically connected, a pad attached to said base member having a plurality of membranes formed therein, each of said membranes being in registry with one of said groups of conductors and creating an individual cavity with said base member, each of said membranes having an actuating key at the upper end thereof, and a wall portion flaring outwardly from said actuating key to said pad, said wall portion having a predetermined collapse load characteristic, a plurality of inner members separate from said outer membranes, each of said inner members being smaller than said outer membranes and having an upper end, and a lower end, said inner members dimensioned to be mounted to said outer membranes within the cavity formed between said base member, wherein said lower ends of said inner members are disposed above said circuit means, and at least one electric conductor mounted to each of said inner members, said electric conductor electrically connecting selected ones of said conductors in said circuit means when said outer membrane exceeds its collapse load characteristic.

* * * * *